United States Patent [19]

Kamada et al.

[11] Patent Number: 4,795,860

[45] Date of Patent: Jan. 3, 1989

[54] PUSH SWITCH

[75] Inventors: Soetsu Kamada; Akinori Ito, both of Furukawa, Japan

[73] Assignee: Alps Electric Co., Ltd., Japan

[21] Appl. No.: 89,687

[22] Filed: Aug. 25, 1987

[30] Foreign Application Priority Data

Sep. 19, 1986 [JP] Japan ..... 61-142710[U]

[51] Int. Cl.[4] ..... H01H 9/26

[52] U.S. Cl. ..... 200/5 B; 200/5 F; 200/524

[58] Field of Search ..... 200/5 R, 5 B, 5 C, 5 D, 200/5 E, 5 EA, 5 EB, 50 C, 153 J, 153 JH, 328, 17 R

[56] References Cited

U.S. PATENT DOCUMENTS 4,295,012 10/1981 Keeler et al. ..... 200/5 B
4,392,029 7/1983 Schaad et al. ..... 200/5 B
4,447,686 5/1984 Fieber et al. ..... 200/153 J
4,575,590 3/1986 Hattori et al. ..... 200/5 E X
4,636,601 1/1987 Tanabe ..... 200/153 J
4,692,573 9/1987 Fukuyama et al. ..... 200/5 E

*Primary Examiner*—J. R. Scott
*Attorney, Agent, or Firm*—Guy W. Shoup; Paul J. Winters; Leighton K. Chong

[57] ABSTRACT

A push switch comprises first and second push/lock mechanisms, and first and second switch units. The operating members of the first and second push/lock mechanisms are disposed opposite to the corresponding levers of the first and second switch units. A first driving pin whose one end is secured to the slider of the first switch unit is pressably engaged at the other end with cam member of the second push/lock mechanism, whereas a second driving pin whose one end is secured to the slider of the second switch unit is pressably engaged at the other end with the cam member of the first push/lock mechanism.

3 Claims, 6 Drawing Sheets

PUSH SWITCH

BACKGROUND OF THE INVENTION

1. Field of the Invention

This invention relates to a push switch and, more particularly, to a so-called interlocking/single-acting type of push switch wherein as a first one out of two knobs is depressed it is locked at a depressed position (a single-acting mode), whereas as a second one is depressed with the first one in the locked state the second knob is locked and concurrently the first knob is unlocked (an interlocking mode).

2. Description of the Prior Art

Japanese Patent Laid-Open No. 61-47027 discloses a switch of the interlocking/single-acting type, which is shown in FIGS. 9 through 20.

In FIGS. 9 through 13, 31 is a casing equipped with fixed terminals 32. 33*a* and 33*b* are operating members slidable in the casing 31 for controlling respective movable contacts 34, each having a sector-shaped hole 35 formed in one side surface thereof. 36*a* and 36*b* are stopper pins accommodated in the respective sector-shaped holes 35, each being rockable about a supporting point 37 in the direction of the arrow J as shown in FIG. 11. 38*a* and 38*b* are springs for returning the respective operating members 33*a* and 33*b*. 39 is an interlocking plate having two heart-shaped cam grooves 40*a* and 40*b* formed therein with which respective movable ends 41 of the stopper pins 36*a* and 36*b* are in contact, and held in receiving portions 42 of the casing 31 such that the interlocking plate 39 can turn about its support shafts 43 provided at either end thereof. 44 is a torsion coil spring for resiliently pressing respective bottom surfaces 45*a* and 45*b* of the heart-shaped cam grooves against the respective movable ends 41*a* and 41*b* of the stopper pins 36*a* and 36*b*, whose working end 46 is supported in a working hole 47 of the interlocking plate 39 with its stationary end 48 in a fixing hole 49 of the casing 31. 50 is a cover for guiding the operating members 33*a* and 33*b* and preventing the operating members 33*a* and 33*b* and the interlocking plate 39 from falling off from the casing 31, which is secured to the casing 31 by means of convex portions 51 of the casing 31.

The operation of the interlocking type push switch of the foregoing structure will now be described.

The interlocking operation will first be described with reference to FIGS. 13 through 20. FIG. 13 shows a switch unit K in the released state and another switch unit L in the locked state, FIGS. 14 through 16 are sectional views of the portion of the heart-shaped cam groove 40*a* of the switch unit K, and FIGS. 17 through 19 are sectional views of the identical portion of the switch unit L. Under the illustrated condition, as the switch unit K is depressed, the movable end 41*a* of the stopper pin 36*a* of the switch unit K traces the heart-shaped cam groove 40*a* so that it moves from point M in the direction of the arrow as shown in FIG. 20, and upon reaching face N, the interlocking plate 39 turns about the support shafts 43 as shown in FIG. 15. In response to a turn of the interlocking plate 39, the movable end 41*b* of the stopper pin 36*b* of the switch unit L separates from point Q of the heart-shaped cam groove 40*b* as shown in FIG. 18, so that the switch unit L changes from the locked state shown in FIG. 17 to the released state shown in FIG. 19, that is, the switch unit L is completely released. If the switch unit K is further subjected to the depression operation, the movable end 41*a* of the stopper pin 36*a* reaches full-stroke point P. As the depression force is removed, release action is recovered and the switch unit K comes to the locked state at point Q, hence, the interlocking operation between the switch units K and L is completed. Of course, the identical interlocking operation can also be accomplished even when the switch units K and L are reversed in the order of operation.

Now, the self-locking operation will be described with reference to FIGS. 13 through 16 and FIG. 20. FIG. 13 shows the switch unit K in the released state, and FIG. 14 shows the condition in sectional view of the portion of the heart-shaped cam groove 40*a* in the released state. Incidentally, in this state the movable end 41*a* of the stopper pin 36*a* of the switch unit K stands at point M as shown in FIG. 20. As the depression operation is performed under this condition with respect to the switch unit K, the movable end 41*a* traces the heart-shaped cam groove 40*a* in the direction of the arrow, so that after passing over point N, the movable end 41*a* reaches full-stroke point P. If the depression force is removed in this state, the movable end 41*a* effects tracing in the direction of the arrow and reaches point Q so that the switch unit K comes to the locked state. In this state, if the depression operation is performed again with respect to the switch unit K, the movable end 41*a* effects tracing in the direction of the arrow and reaches full-stroke point R. Upon removal of the depression force, the movable end 41*a* effects tracing in the direction of the arrow and returns to point M, and at this moment the switch unit K recovers its initial released state. Of course, the identical self-locking operation can also be accomplished by the switch unit L.

In the foregoing conventional switch, however, since the two heart-shaped cam grooves 40*a* and 40*b* are formed in the interlocking plate 39 with a certain spacing left therebetween, the spacing between the operating members 33*a* and 33*b* workable in association with the respective cam grooves 40*a* and 40*b* is also restricted, so that the applicability of this type of switch is poor. Further, since the interlocking plate 39 is pulled toward the movable ends 41*a* and 41*b* of the stopper pins 36*a* and 36*b* at a position deviated from the center thereof by the torsion coil spring 44 whose working end 46 is fitted in the working hole 47 of the interlocking plate 39 with the stationary end 48 supported at the fixing hole 49 of the casing 31, both pulling forces acting at the movable ends have a certain correlation therebetween and tend to lose a balance. Where a balance is lost, there is a fear that the push/lock mechanisms will cause malfunction.

SUMMARY OF THE INVENTION

The present invention has been devised to overcome the foregoing drawback of the prior art, thus, it is an object of the present invention to provide a push switch which allows easily alteration of the size of the spacing between two operating members, possesses a wide applicability, and causes no malfunction.

To achieve the forgoing object, the present invention provides a push switch which comprises: first and second push/lock mechanisms composed of first and second operating members slidable in a frame, first and second operating rods rockably supported by the respective operating members, first and second cam members formed with individual heart-shaped cam grooves engageable with the respective operating rods, and first and second spiral springs for urging such that the heart-shaped cam grooves come to contact resiliently with the respective distal ends of the operating rods; and first and second switch units composed of switch casings equipped with fixed terminals, and sliders slidable in the respective switch casings and equipped with individual levers for controlling respective movable contacts, wherein the first and second operating members are disposed opposite to the respective levers of the first and second switch units such that the operating members can push the respective levers; and is characterized in that a first driving pin whose one end is secured to the slider of the first switch unit is pressably engaged at the other end with the second cam member, and a second driving pin whose one end is secured to the slider of the second switch unit is pressably engaged at the other end with the first cam member.

According to the present invention, since the cam member formed with the heart-shaped cam groove is provided individually with respect to each operating member, the spacing between the two operating members can arbitrarily be set to any desired size, hence, the applicability of the switch is enhanced. Further, since each pressing force acting between the distal end of each operating rod and the corresponding cam member can individually be set, the switch causes no malfunction.

BRIEF DESCRIPTION OF THE DRAWINGS

FIGS. 1 through 8 are explanatory diagrams of an embodiment of the present invention in which FIG. 1 is an overall perspective view of a switch;

FIG. 2 is a plan view of the switch with knobs removed;

FIG. 3 is an exploded perspective view of an important portion of the switch;

FIG. 4 is a diagram explanatory of the operation of the switch;

FIG. 5 is a diagram explanatory of the relationship between the switch and a cam member;

FIGS. 6(*a*) and 6(*b*) are sectional views showing an operating rod being supported by an operating member;

FIGS. 7(*a*) and 7(*b*) are a plan view and a sectional view, respectively, of a heart-shaped cam groove; and FIGS. 8(*a*), 8(*b*), 8(*c*) and 8(*d*) are diagrams explanatory of the action between the heart-shaped cam groove and the operating rod; and FIGS. 9 through 20 are explanatory diagrams of a conventional switch in which FIG. 9 is an exploded perspective view of a single-acting/interlocking push switch;

FIG. 10 is a vertical sectional view;

FIG. 11 is a detailed view of the portion of a stopper pin;

FIG. 12 is a transverse sectional view;

FIG. 13 is a detailed view of the portion of an interlocking plate;

FIGS. 14 through 19 are detailed sectional views showing the stopper pin and the interlocking plate; and FIGS. 20(*a*) and 20(*b*) are a sectional view and a front view, respectively, showing in greater detail the portion of a heart-shaped cam groove.

DESCRIPTION OF THE PREFERRED EMBODIMENT

An embodiment of the present invention will now be described with reference to FIGS. 1 through 8(*d*).

Figure 1:
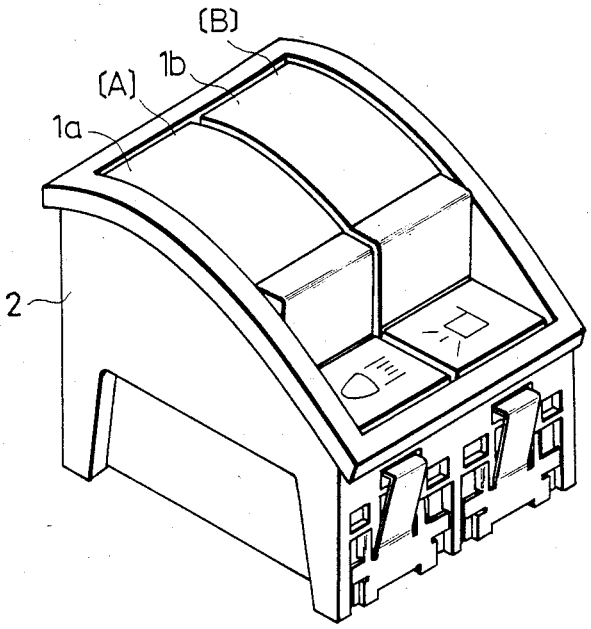
Figure 2:
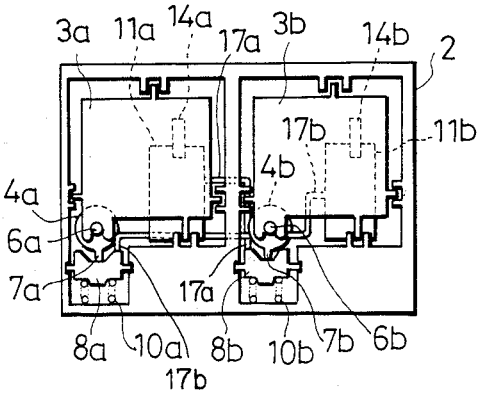
Figure 3:
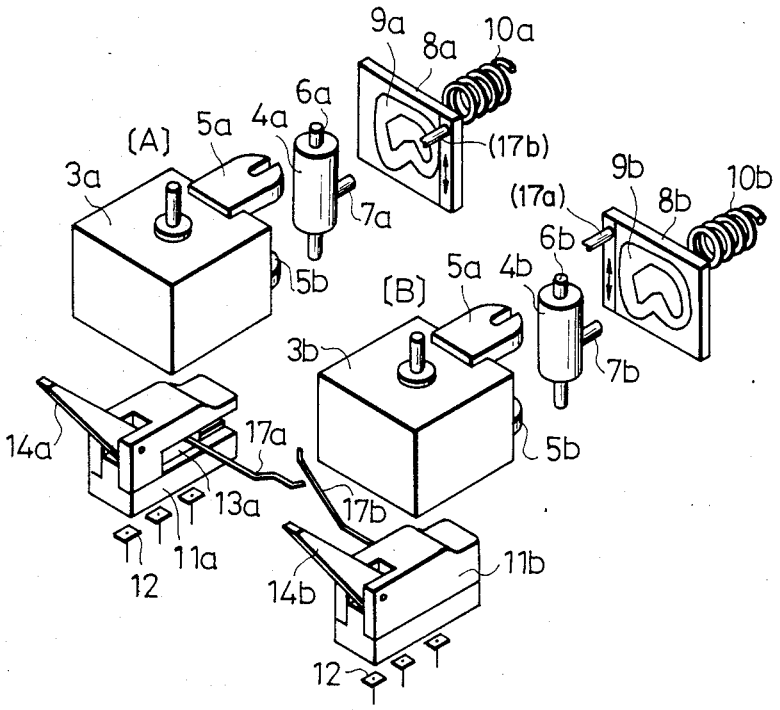
Figure 4:
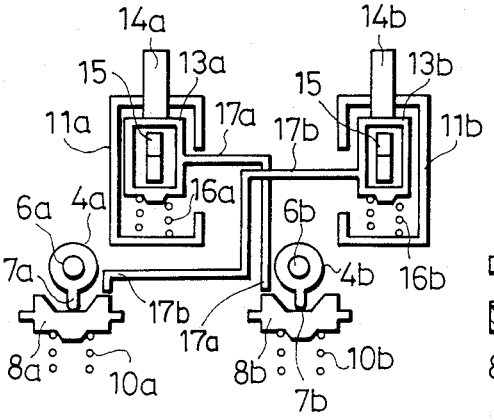
Figure 5:
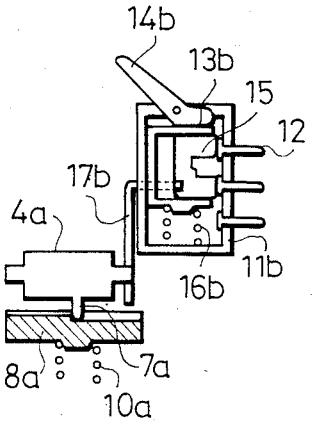
Figure 6A:
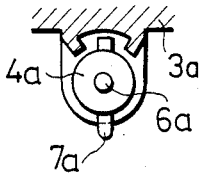
Figure 6B:
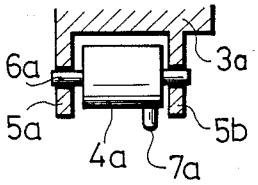

In FIG. 1, reference symbol A designates a first switch unit, B designates a second switch unit, 1*a* and 1*b* designate knobs of the units, and 2 designates a frame made of insulating material. In FIGS. 2 and 3, 3*a* and 3*b* designate operating members integral with the respective knobs 1*a* and 1*b*, and 4*a* and 4*b* designate cylindrical driving members whose support shafts 6*a* and 6*b* are rockably supported by respective support plates 5*a* and 5*b* provided on one side of the operating members 3*a* and 3*b*. 7*a* and 7*b* designate operating rods projecting from respective central portions of the driving members 4*a* and 4*b*, and 8*a* and 8*b* designate cam members formed on one side with individual heart-shaped cam grooves 9*a* and 9*b* known in the art, these cam members 8*a* and 8*b* being resiliently urged toward the respective driving members 4*a* and 4*b* by respective spiral springs 10*a* and 10*b* interposed between the frame 2 and the respective cam members 8*a* and 8*b* so that the distal ends of the operating rods 7*a* and 7*b* are in contact resiliently with the respective cam grooves 9*a* and 9*b*. The operating member 3*a*, operating rod 4*a*, cam member 8*a*, and spiral spring 10*a* make up a first push/lock mechanism, whereas the operating member 3*b*, operating rod 4*b*, cam member 8*b*, and spiral spring 10*b* make up a second push/lock mechanism.

In FIGS. 4 and 5, 11*a* and 11*b* designate switch casings made of insulating material, 12 designates fixed terminals provided in the respective casings 11*a* and 11*b*, 13*a* and 13*b* designate sliders slidably accommodated in the respective switch casings 11*a* and 11*b*, and 14*a* and 14*b* designate levers integral with the respective sliders 13*a* and 13*b*, these sliders 13*a* and 13*b* having individual movable contacts 15 accommodated therein. 16*a* and 16*b* designate springs for resiliently urging the respective sliders 13*a* and 13*b*.

The switch casing 11*a* and the slider 13*a* make up a first switch, whereas the switch casing 11*b* and the slider 13*b* make up a second switch.

17*a* designates a driving pin whose one end is secured to the slider 13*a* of the first switch with the other end being in engagement with the surface of the cam member 8*b* of the second switch such that the surface can be pushed thereby. 17*b* designates another driving pin whose one end is secured to the slider 13*b* of the second switch with the other end being in engagement with the surface of the cam member 8*a* of the first switch such that the surface can be pushed thereby.

The operation of the switch according to the present invention will now be described.

First, the operation of self-locking each unit under the condition that both switch units A and B are in the released state will be described, specifically, taking the switch unit A as an example.

FIG. 8(*a*) shows the state before operation, in which the distal end of the operating rod 7*a* is positioned on an upper flat portion 25 of the heart-shaped cam groove 9*a*. In this state, as the operating member 3*a* is depressed in opposition to the return spring, the distal end of the operating rod 7*a* climbs an inclined surface 26 of the bottom of the heart-shaped cam groove 9*a* and after passing over a step 21 between the inclined surface 26 and a flat portion 27, falls on this flat portion 27. Then, as the depression force is removed from the operating member 3*a*, the operating member 3*a* is pushed back by the return spring and tends to move. However, the distal end of the operating rod 7*a* is guided by the step 21 as shown in FIG. 8(*b*) and after passing over a next step 22, falls on a flat portion 28. Then, the distal end of the operating rod 7a comes into a concave portion 29 at the top of the heart-shaped cam groove 9a and is locked by the concave portion 29 as shown in FIG. 8(*c*). That is, the operating member 3a is locked at a somewhat secluded position. Concurrently, the slider 13a of the first switch also moves to turn on its contact.

Figure 7A:
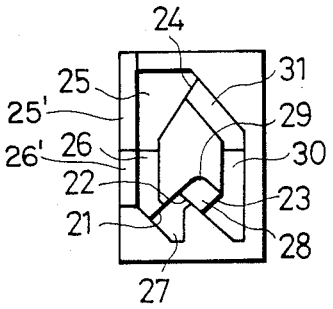
Figure 7B:
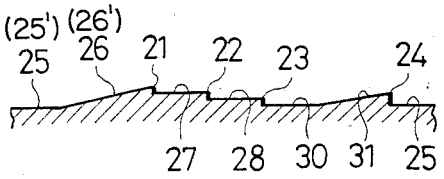
Figure 8A:
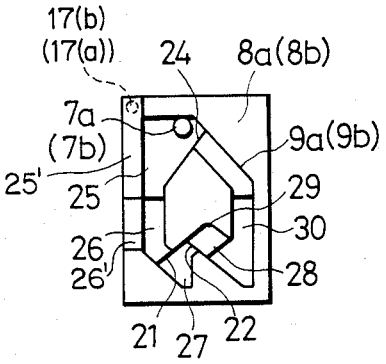
Figure 8B:
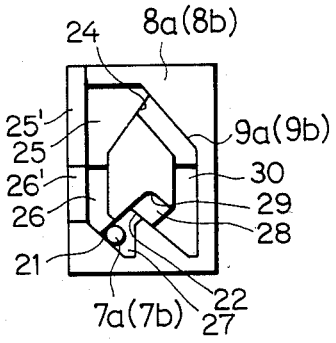
Figure 8C:
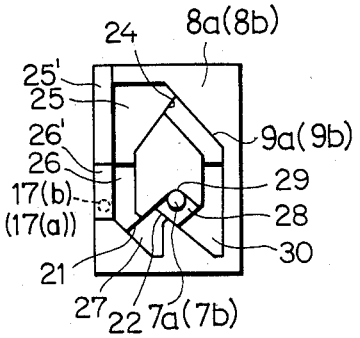
Figure 8D:
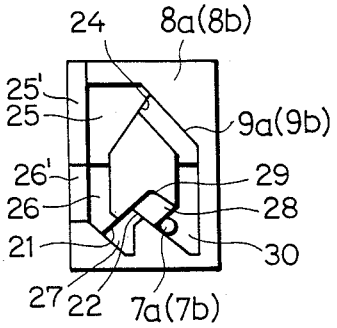
Figure 9:
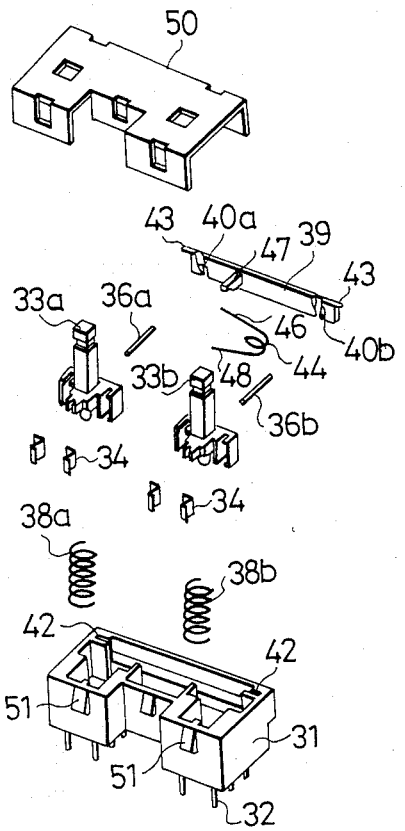
Fig. 9 PRIOR ART
Figure 10:
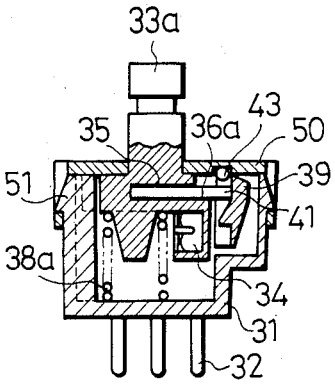
Fig. 10 PRIOR ART
Figure 11:
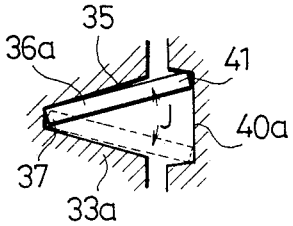
Fig. 11 PRIOR ART
Figure 12:
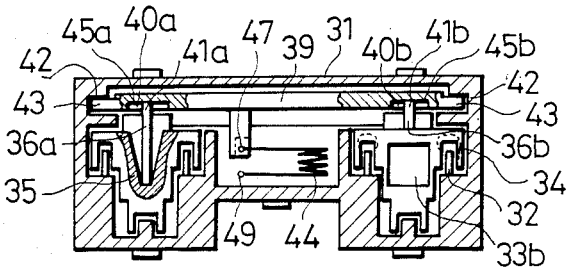
Fig. 12 PRIOR ART
Figure 13:
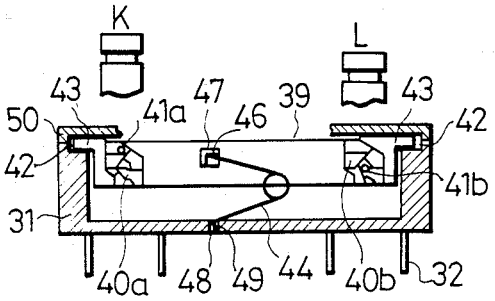
PRIOR ART Fig.13
Figure 14:
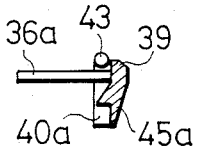
PRIOR ART Fig.14
Figure 15:
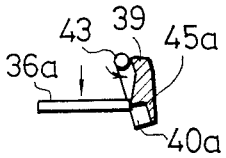
PRIOR ART Fig.15
Figure 16:
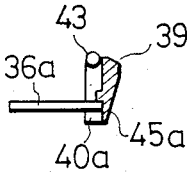
PRIOR ART Fig.16
Figure 17:
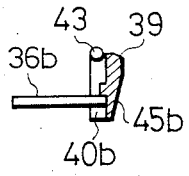
PRIOR ART Fig.17
Figure 18:
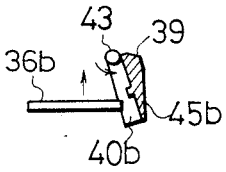
PRIOR ART Fig.18
Figure 19:
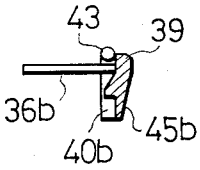
PRIOR ART Fig.19
Figure 20A:
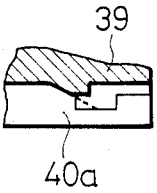
PRIOR ART Fig.20(a)
Figure 20B:
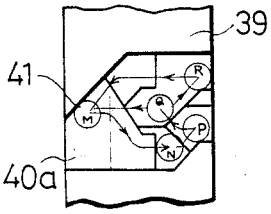
PRIOR ART Fig.20(b)

Referring to FIGS. 7(*a*), 7(*b*), and 8(*d*), when the operating member 3a is again depressed to release it from the locked position, the driving pin 7a moves downward over the step 23, to the flat portion 30. Then, as the operating member is released and pushed upward by the force of the return spring 16a, the driving pin moves up an inclined portion 31, across a step 24, and returns to the original upper flat portion 25.

On the basis of the same principle of operation as the above, the switch unit B can also be self-locked.

Next, the interlocking operation under the condition that the switch unit B is locked and the switch unit A is released, for example, will be described.

As the knob 1a is depressed under the foregoing condition, self-lock is achieved on the basis of the foregoing principle of operation. During this operation, the driving pin 17a whose one end is secured to the operating member 3a moves down together with the operating member 3a. As one embodiment, the end of the driving pin 17a is disposed along one side of the cam member 8b, and the end of the driving pin 17b is disposed along one side of the cam member 8a, each driving pin being disposed to push the cam member of the opposite switch to release it according to the interlocking function. As shown in FIGS. 7(*a*), 7(*b*), and 8(*a*)–8(*d*), the side of the cam member is configured to have a flat portion 25', similar to flat portion 25 of the heart-shaped cam 9b, and inclined portion 26', similar to the flat portion 26. Thus, when the operating member 3a is pushed down, the end of the driving pin 17a is also pushed down therewith as it bears against the side of the opposite cam member 8b. When the end of the driving pin 17a bears against the inclined portion 26', it pushes the cam member 8b in opposition to the resiliency of the spring 10b, so that the distal end of the operating rod 7b confined in the concave portion 29 as shown in FIG. 8(*c*) is unlocked as shown in FIG. 8(*d*), and returns to the released state as shown in FIG. 8(*a*) owing to the resiliency of the return spring. Accordingly, the switch of the switch unit A is turned on while the switch unit B is turned off, whereby the interlocking operation is completed.

The similar interlocking operation as the above can be accomplished even when the order of operation between the switch units A and B is reversed.

On the other hand, if both knobs 1a and 1b are depressed concurrently, the cam members 8a and 8b are pushed concurrently by the respective driving pins 17a and 17b, so that both operating rods 7a and 7b cannot be locked in the respective cam grooves 9a and 9b, whereby the initial released state is preserved.

Since the push switch according to the present invention has the foregoing structure wherein the cam members 8a and 8b formed with the individual heart-shaped cam grooves 9a and 9b are provided independently with respect to the respective operating members 3a and 3b, the spacing between the operating members 3a and 3b can arbitrarily be set to any desired size, hence, the applicability of the switch is wide. Further, since one pressing force acting between the distal end of the operating rod 7a and the cam member 8a and the other pressing force acting between the distal end of the operating rod 7b and the cam member 8b can individually be set without depending upon each other, this setting operation can easily and surely be achieved, hence, no malfunction results.

As described hereinabove, according to the present invention, the cam member formed with the heart-shaped cam groove is provided individually with respect to each operating member, thus, the spacing between the two operating members can arbitrarily be set to any desired size, hence, the applicability of the switch is enhanced.

Further, each pressing force acting between the distal end of each operating rod and the heart-shaped cam groove of the cam member associated with the former can independently be set without any relation to the other, thus, this setting operation can easily and surely be achieved, hence, the switch causes no malfunction.

What is claimed is:

1. A push switch having first and second switch units equipped with respective first and second push/lock mechanisms having an interlocking function, comprising:

first and second operating members for said first and second switch units respectively, provided slidably in a frame, each of said operating members being slidable from an initial position to a locking position when depressed in one direction in opposition to a return spring and returned by the returning force of the return spring when it is released in a return direction;

first and second operating rods supported by and movable along with a respective one of said first and second operating members in said one and return directions when the respective operating member is depressed and released;

first and second cam members provided independently of each other in the frame, each cam member being formed with an individual heart-shaped cam groove in which a respective one of said first and second operating rods is engaged and along which it moves so as to lock the respective operating member in the locking position when the operating member is depressed in the one direction and release the respective operating member back to the initial position when the operating member is released in the return direction;

first and second biasing springs for urging said first and second cam members, respectively, toward the respective operating members so that the operating rods are biasingly engaged in the heart-shaped cam grooves, wherein each of said cam members can be pushed against the urging force of its biasing spring to allow the operating rod to move along the heart-shaped cam groove to the locking position and back to the initial position;

a first driving pin having one end secured to the first switch unit and its other end disposed engagingly with said second cam member, said first driving pin being moved by the movement of said first operating member when depressed in said one direction so as to push said second cam member against the urging force of its biasing spring and release said second operating rod of said second operating member back to the initial position if it is in the locking position in the cam groove thereof; and a second driving pin having one end secured to the second switch unit and its other end disposed engagingly with said first cam member, said second driving pin being moved by the movement of said second operating member when depressed in said one direction so as to push said first cam member against the urging force of its biasing spring and release said first operating rod of said first operating member back to the initial position if it is in the locking position in the cam groove thereof.

2. A push switch according to claim 1, wherein each of said operating rods is supported so as to be swingable in directions transverse to said one and return directions in order to allow the operating rod to be swung transversely as it is moved along the heart-shaped cam groove, each said operating rod having a member projecting toward the cam groove from a cylindrical member which is supported on its axis by a support plate attached to the respective operating member.

3. A push switch according to claim 1, wherein each of said operating members is depressable by a corresponding, manually operated knob for a respective one of said switch units.

* * * * *

UNITED STATES PATENT AND TRADEMARK OFFICE

CERTIFICATE OF CORRECTION

PATENT NO. : 4,795,860

DATED : January 3, 1989

INVENTOR(S) : Soetsu Kamada, Akinori Ito

It is certified that error appears in the above-identified patent and that said Letters Patent is hereby corrected as shown below:

On the Title Page, Item [54] and in column 1, line 2,

Title should read --PUSH SWITCH ASSEMBLY WITH INTERLOCK MECHANISM--.

Signed and Sealed this

Twenty-second Day of August, 1989

*Attest:*

DONALD J. QUIGG

*Attesting Officer*

*Commissioner of Patents and Trademarks*